US006021853A

United States Patent [19]

Atkins

[11] Patent Number: 6,021,853

[45] Date of Patent: Feb. 8, 2000

[54] FIELD FINISHING LAND PLANE HAVING RETRACTABLE SECTIONS FOR ROAD SAFETY DURING TOWING

[75] Inventor: Ralph H. Atkins, P.O. Box 1047, Paradise, Calif. 95967

[73] Assignee: Ralph H. Atkins, Paradise, Calif.

[21] Appl. No.: 09/211,166

[22] Filed: Dec. 14, 1998

[51] Int. Cl.[7] ..... E02F 3/12

[52] U.S. Cl. ..... 172/780; 172/456; 172/459; 172/675; 172/684.5; 172/701.1; 172/776

[58] Field of Search ..... 404/85, 86, 122, 404/125, 132, 128; 37/271, 274, 281, 266, 207; 172/452, 456, 458, 669, 776, 311, 451, 780, 395, 799.5, 684.5, 675, 701.1, 722, 730, 397, 720

[56] References Cited

U.S. PATENT DOCUMENTS

| | | | |
|---|---|---|---|
| 2,870,554 | 1/1959 | Marvin | 172/780 |
| 3,032,902 | 5/1962 | Shumaker | 172/4.5 |
| 3,266,181 | 8/1966 | Olafson | 172/780 |
| 3,435,546 | 4/1969 | Iverson | 37/381 |
| 3,692,121 | 9/1972 | Kenney | 172/456 |
| 3,722,920 | 3/1973 | Reese | 280/446 B |
| 3,724,556 | 4/1973 | Servatius | 172/780 |
| 3,874,459 | 4/1975 | Herberholz | 172/311 |
| 4,236,586 | 12/1980 | Shader et al. | 172/456 |
| 4,869,327 | 9/1989 | Korf | 172/211 |
| 5,213,165 | 5/1993 | Dunn et al. | 172/799.5 |
| 5,890,546 | 4/1999 | Kerpash, Sr. | 172/684.5 |

*Primary Examiner*—Thomas B. Will
*Assistant Examiner*—Nathan Mammen

[57] ABSTRACT

A field finishing land plane has a V-shaped, horizontally oriented frame converging at a front end affixed pivotal to steerable rollers in a yoke fastened to a tow tongue. The pivotal front is housed in a protective shielding. A cross member that attaches to the wide section of the V frame at the rear of the land plane extends outward from the V ends on each side. The outward extensions have individual rollers attached to swivel at the outer ends. Supported by internal framing and operated hydraulically, pneumatic tired, retractable road wheels can be raised for field use of the land plane and lowered for on-road towing. For field use with the road wheels raised, the land plane of this invention rests on the front steerable rollers and on the rear swivel rollers so that a long crosswise scooping bucket located centrally under the main frame of the land plane makes ground contact. For road safety during towing with road wheels down, the long crosswise scooping bucket has rotatable end sections. The end sections attach pivotal to the frame of a fix center section of the bucket and can be rotated to a vertical position narrowing the wide center area of the road plane to an acceptable public road size. For further road safety, facing surfaces of butt hinges on the rear roller support sections can be unbolted allowing the roller support sections and rear rollers to be swung around towards the center of the rear frame member to narrow the rear of the land plane. The rear rollers when turned to the back are fixed in position by a safety line between them. Hydraulic cylinders operate the rotatable bucket sections and safety attachments maintain them positioned vertically.

9 Claims, 4 Drawing Sheets

FIELD FINISHING LAND PLANE HAVING RETRACTABLE SECTIONS FOR ROAD SAFETY DURING TOWING

BACKGROUND OF THE INVENTION

This invention relates to land-grading equipment. The present invention is particularly directed towards a field finishing land plane, a special type of grader equipped with an elongated bucket for scooping and rollers for compacting so it can be towed by a tractor for leveling large land areas. A Land plane is normally of considerable length and width making it difficult for a towing vehicle to transport it from job site to job site along a public road.

BRIEF SUMMARY OF THE INVENTION

Therefore, in practicing my invention, I provide a field finishing land plane with retractable sections for road safety during towing. Where the bucket ends of a normal land plane extend a considerable distance out each side away from the main frame—far enough to actually block a roadway—the extending bucket ends of my design are pivotal at the frame edge to swing upwards. Pulled to a vertical position by hydraulic cylinders, the bucket end sections are secured immediate to the main frame by safety arms. This narrows the land plane of the present invention centrally to a safe road-travel width size. Retractable rubber tired road wheels directly rear of the bucket sections can be raised allowing the land plane of this invention to ride down on rollers for use in the field. The retractable tired road wheels can be lowered for towing it from place to place. As the rear frame of the land plane V's outwardly, a further safety improvement includes hinged sections on which the rear rollers are mounted. This allows the roller support sections to be released and the rollers swung around towards the rear center of the back frame narrowing the rear section of the land plane for additional road towing safety. A special housing covers the tongue and frame pivotal attachment area at the front of the land plane.

A principal object of the present invention is to provide a field finishing land plane with retractable sections for road safety during towing.

Another object of my invention is to provide a field finishing land plane with rubber tired road wheels directly rear of the bucket sections that can be raised for field use of the land plane and lowered for towing it from place to place.

As the frame of the land plane V's outwardly at the rear, a further road safety object of this invention includes hinged support sections on which the rear rollers are mounted that allows the roller support sections to be released and the rollers swung around towards the center of the rear frame member.

Other objects and the many advantages of the present invention will be better understood by reading the following specifications and comparing numbered parts described with like numbered parts illustrated in the drawings.

DETAILED DESCRIPTION OF THE INVENTION.

Figure 1:
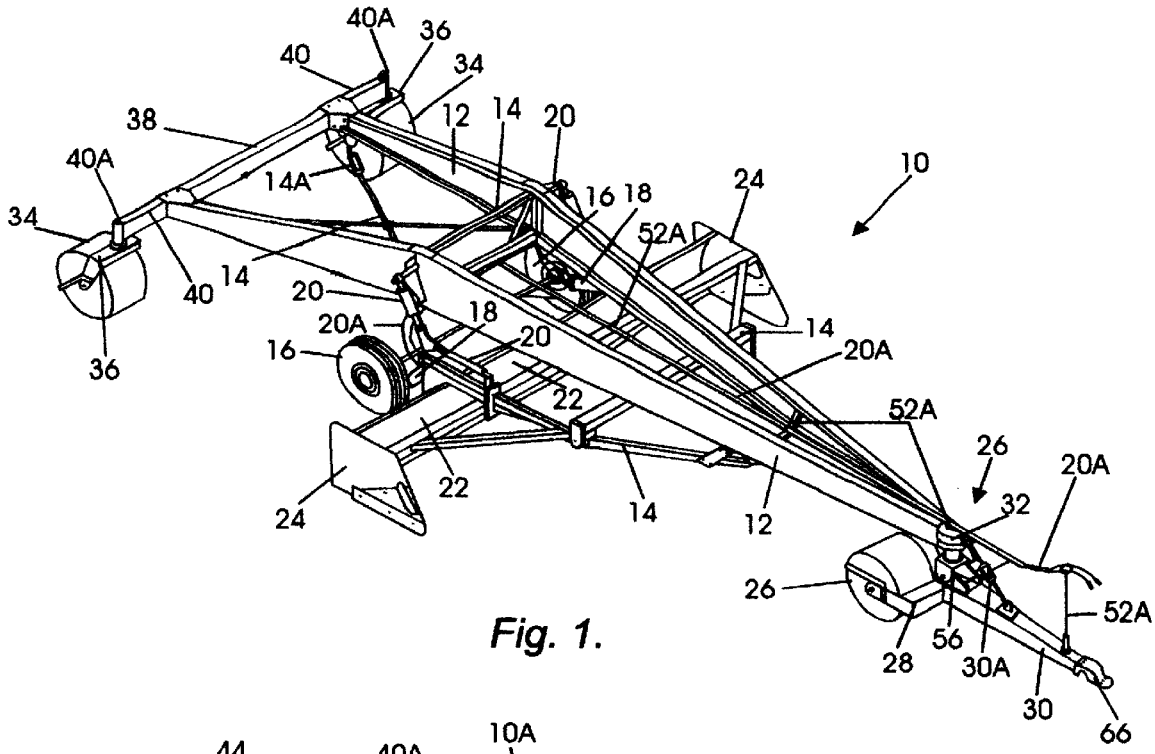
FIG. 1 shows original structure of a field finishing land plane from an angled top perspective view.

Referring now to the drawing figures where an original version of this invention is illustrated in FIG. 1 as land plane 10. The numbered parts in the land plane 10 version include two horizontally aligned parallel girders forming a V-shaped main frame 12 widened at attachments to a rear cross member 38 at the rear of land plane 10 and converging at the front of land plane 10 into nose section 32. Nose section 32 is fastened by swivel tongue attach member 56 to tongue 30. The integrity of main frame 12 is maintained by main frame supports 14 and corner turnbuckles 14A. A pair of phenumatic tired road wheels 16 can be seen to the rear of bucket 22. For some local use, road wheels 16 might not have phenumatic tires. Road wheels 16 are retractable through activation of hydraulic cylinders 18 and guide supports 20. Road wheels 16 can be both raised and lowered. Hydraulic lines 20A are the fluid supply lines for hydraulic cylinders 18. Main frame supports 14 also maintain bucket 22. Bucket 22 is a horizontal scoop affixed crosswise under the center of main frame 12. Guide ends 24 are at each terminal end of bucket 22. Front rollers 26 are in front roller yokes 28 which in turn attaches to tongue 30 at swivel tongue attachment 56. Front rollers 26 are steerable and follow tongue 30 in the direction of tow. Front rollers 26 can be temporarily replaced by another pair of phenumatic tired road wheels 16 if needed. Rear rollers 34 mounted in rear roller yokes 36 are attached pivotally at the ends of rear roller support ends 40 by rear roller swivel attachments 40A. In the original land plane 10 version, roller support ends 40 are rigid extensions of rear cross member 38. Two hydraulic lines 20A that provide hydraulic fluid for charging wheel hydraulic cylinders 18 run along the center of main frame 12 from nose section 32 to the wheel area in the center of main frame 12. Supports for hydraulic lines 20A included attachments to cross members 14 as indicated at points 52A and a vertical rod with a rounded upper end on top of tongue 30 also indicated on the drawing as 52A. For towing, a ball hitch 66 is affixed at the free end of tongue 30.

Figure 2:
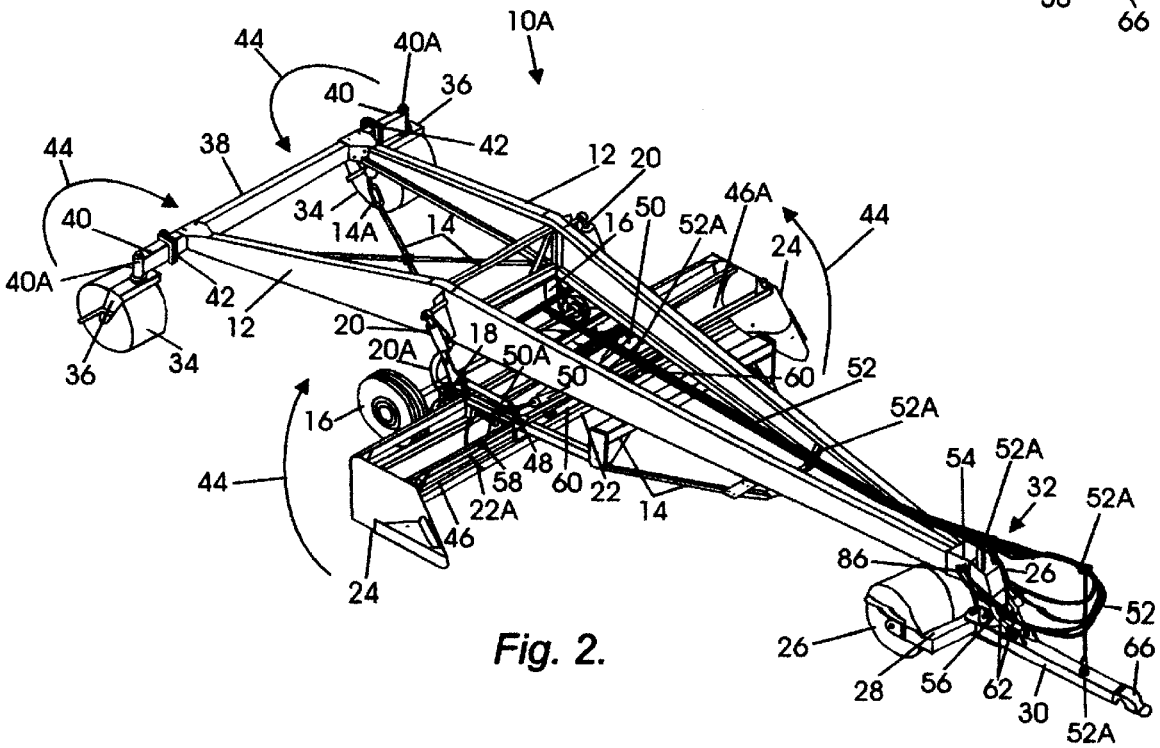
FIG. 2 shows the land plane of FIG. 1 modified according to the present invention.

Modified land plane 10A, in accordance with the invention, is illustrated in FIG. 2. Original numbers are retained on parts that are basically the same on land plane 10 and modified land plane 10A. Improvements to modified land plane 10A, however, are renumbered and described in the following.

Although only one can be seen in the FIG. 2 illustration, bucket 22 has two break areas 22A and bucket 22 is structured in three close-fitting sections. The sections include a rotatable first bucket section 46, a fixed second bucket section 22 (retains the original number) and, a rotatable third bucket section 46A. The second fixed bucket section 22 provides rigid center support for pivotal attachment 48 at both ends for the two rotatable sections, first rotatable bucket section 46 and third rotatable bucket section 46A. Bucket sections 46 and 46A extend outward on each side of V-shaped frame 12 enough to be rotated to a substantially vertical position (See FIG. 6) narrowing the center width of land plane 10A for road towing safety. Bucket hydraulic cylinders 50 attached by arm to fittings 50A on bucket sections 46 and 46A when activated hydraulically can rotate first bucket section 46 and third bucket section 46A from substantially horizontal original positions for field use to substantially vertical positions for on-road towing. Bucket sections 46 and 46A can be returned to the original horizontal use position by reverse action of bucket hydraulic cylinders 50. When in the vertical position, bucket sections 46 and 46A are maintained fixed by safety arms 60 swung around manually and attached to safety arm attachment studs 58. Safety arms 60 ride on frame 14 in the center between the two outside girders of main frame 12 when not in use (See FIG. 7). An alignment of four hydraulic lines 52 supply hydraulic fluid for wheel retract hydraulic cylinders 18 and rotatable bucket hydraulic cylinders 50. Fluid for and control of the hydraulic system is incorporated in equipment provided by a towing vehicle (See FIG. 8) or by auxiliary equipment. In modified land plane 10A, the original rear roller support ends 40 have been separated from rear cross member 38 at rear roller support section hinges 42. Facing flanges of hinges 42 are bolted together to maintain rear roller support ends 40 aligned with rear cross member 38 for field use of modified land plane 10A. For road towing safety, face bolts on the flanges of hinges 42 are released allowing rear roller support ends 40 and rear rollers 34 to swing around on the pins hinges of hinges 42 to a close-in folded position behind rear cross member 38 as indicated by movement arrows 44. This narrows the rear of main frame 12 and rear rollers 34 are retained in the folded position by a safety cord 84 attached between yokes 36. Movement arrows 44 indicate the swing movement of rear rollers 34 to a position behind rear cross member 38. For field use, cord 84 is untied and removed, rear roller support ends 40 are swung out to alignment with rear cross member 38, bolts in the flanges of hinges 42 are reattached, and rear rollers 34 are in their original position outward on rear roller support ends 40. The original attachment nose section 32 shown in FIG. 1 is covered by tubular crescent-shaped nosepiece shielding member 54. Nosepiece shielding member 54 fits over he upper part of swivel tongue attach member 55 and is attached to tongue 30 by tongue shock absorbing cylinders 62.

Figure 3:
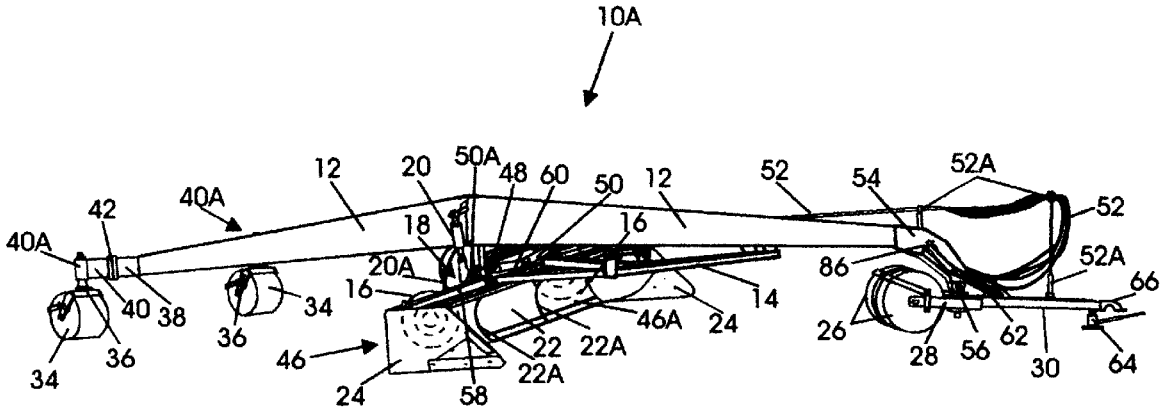
FIG. 3 the modified field finishing land plane according to the invention in a side perspective view riding on front and rear rollers with road wheels retracted ready for field use.

In FIG. 3, modified land plane 10A is shown in field-use condition. Pneumatic tired road wheels 16 are retracted and modified land plane 10A is riding on front rollers 26 and back rollers 34. The position of wheels 16 can be seen in dotted lines. Rotatable end bucket sections 46 and 46A are in a substantially horizontal original down position aligned with fixed bucket 22. Modified land plane 10A in FIG. 3 is ready for field use. A jack 64, not always needed, is ready to raise tongue 30 so ball hitch 66 can be attached to the tow bar on a tractor or other towing vehicle. Towing vehicle 74 (See FIG. 8) normally supplies a pump and hydraulic fluid from a fluid tank for hydraulic lines 52.

Figure 4:
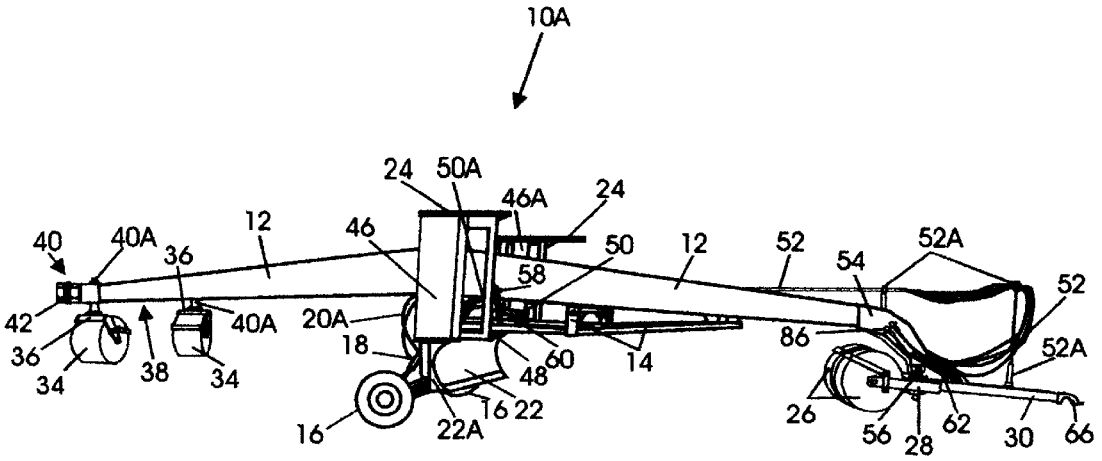
FIG. 4 shows the modified land plane of the present invention with tired road wheels down, with pivotal side bucket sections angled and secured vertically, and with rear roller support sections pivoted around to the back, narrowing the width of the land plane for road-towing safety.

FIG. 4 shows modified land plane 10A of the present invention with tired road wheels 16 down ready for on-road towing. Although only the foreground side is visible, both rotatable side bucket sections 46 and 46A are in a substantially vertical, road-ready position secured by safety arm 60. Rear roller support sections 40 are pivoted around so rear rollers 34 are to the back of rear cross member 38. With parts positioned as illustrated in FIG. 4, the width of modified land plane 10A is considerably narrowed for road-towing safety.

Figure 5:
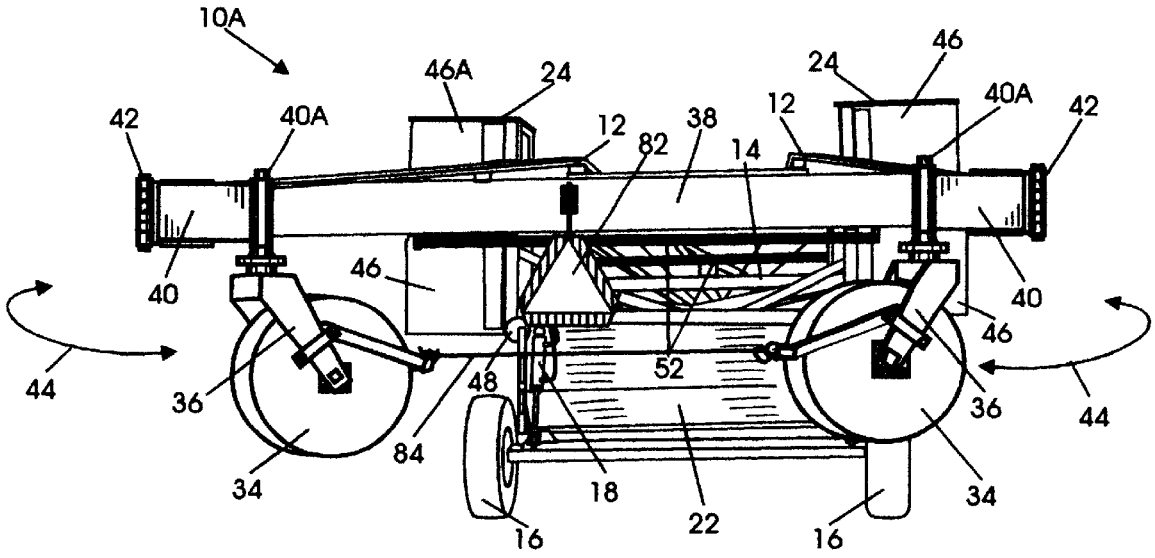
FIG. 5 shows a rear view of the invention with the rear roller sections folded to the back and the rollers secured by a cord tied between the roller yokes.
Figure 8:
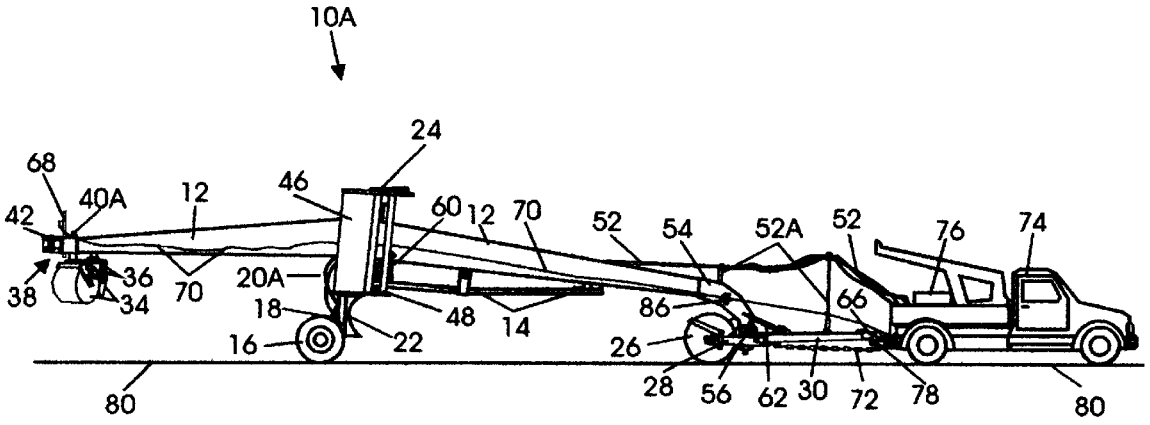
FIG. 8 shows the modified field finishing land plane according to the invention ready for road towing and attached by tongue to a towing vehicle.

An enlarged rear view at FIG. 5 shows modified land plane 10A with rear roller sections 40 and rollers 34 folded to the back of rear cross member 38. Movement arrows 44 indicate the movement. Rollers 34 are secured by cord 84 tied between roller yokes 36 to prevent rollers 34 from pivoting around on rear roller swivel attachments 40A or swinging outward on hinges 42. Although not part of this invention, a rear red framed warning plaque 82 is shown affixed to rear cross member 38. This is usually required for road towing as are provision for lights as shown in FIG. 8. In FIG. 5, crosswise hydraulic feed lines 52 can be seen in the center under and between the two outside girders that form main frame 12. Road wheels 16 are down and bucket sections 46 and 46A have been rotated from a substantially horizontal original position to a substantially vertical position by activating hydraulic cylinders 50.

Figure 6:
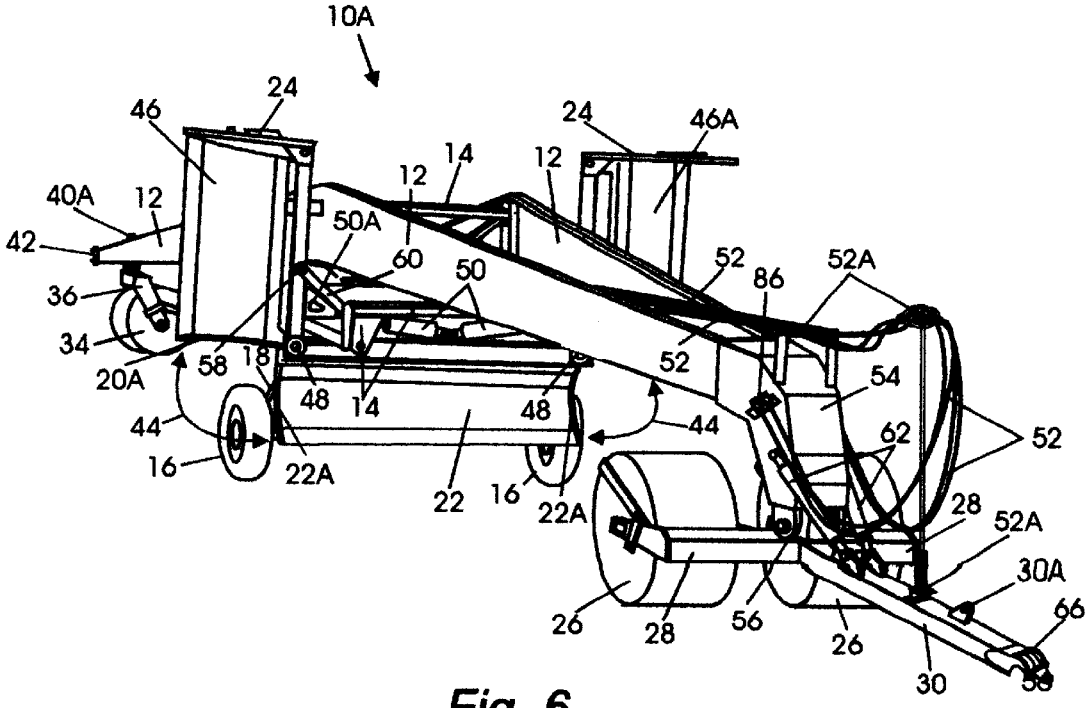
FIG. 6 shows the modified land plane of the present invention in a frontal prospective view.

Modified land plane 10A is shown from an enlarged frontal perspective view in FIG. 6. Rear rollers 34 are folded in and rotatable bucket sections 46 and 46A, secured by safety arms 60 manually attached to safety arm attachment studs 58, are in a substantially vertical position. Arrows 44 illustrate the movement of rotatable bucket sections 46 and 46A. For towing, modified land plane 10A rests on the tires of street wheels 16 and on front rollers 26. Although not illustrated, front rollers 26 can be replaced with additional tired road wheels 16 if needed and the tires on road wheels 16 would normally be pneumatic. Four hydraulic fluid lines 52 extend from holders 52A at the front of V'd main frame 12 of modified land plane 10A to crosswise feed lines 52 centered in main frame 12 (See FIG. 5). Crosswise hydraulic feed lines 52 supply fluid to operate rotatable bucket section hydraulic cylinders 50 and retractable road wheel hydraulic cylinders 18. Tubular crescent shaped nose piece shielding member 54 covering the front conversion attachment of frame 12 and swivel tongue attach member 56 has tongue shock absorbing cylinders 62 and hydraulic line end clips 86 affixed, one on each side. The lower ends of tongue shock absorbing cylinders 62 attach to tabs on tongue 30. An auxiliary safety line tab 30A is illustrated in FIG. 6 on tongue 30, as is ball hitch 66 at the front end of tongue 30.

Figure 7:
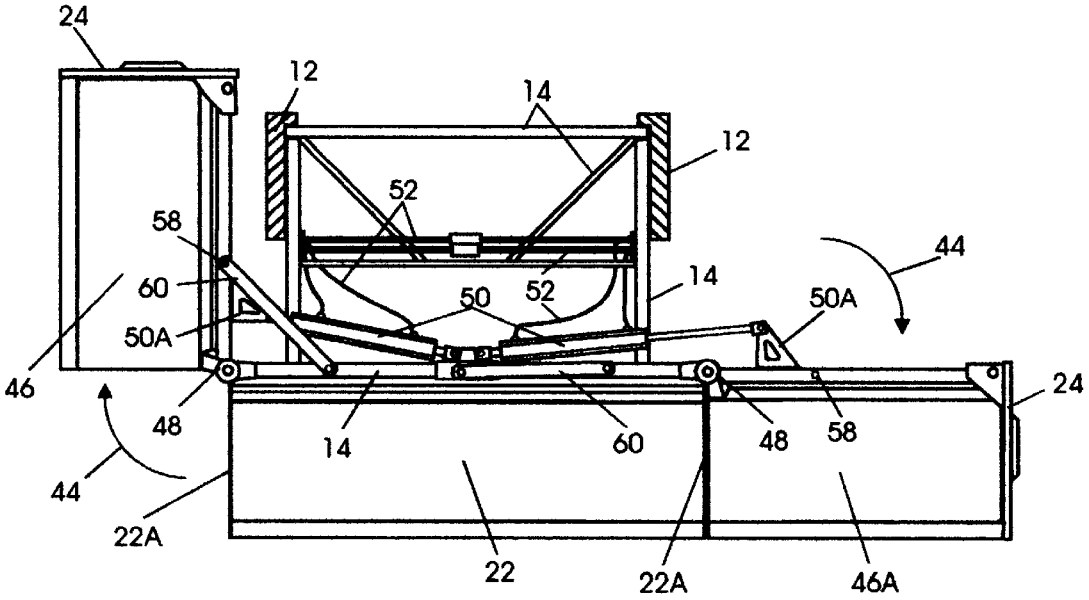
FIG. 7 is a partial view of the bucket sections in accordance with the invention showing one pivotal bucket section raised by hydraulic cylinder and secured vertically by a safety arm and the other pivotal bucket section down in position for field use.

An enlarged partial view of rotatable bucket sections 46 and 46A relative to the center section remaining of original bucket 22 is illustrated in FIG. 7. Main frame 12 is shown sectioned and some principal parts of main frame supports 14 can be seen. Break lines 22A indicate where original bucket 22 was cut to form rotatable bucket sections 46 and 46A. Number designation 22 is retained for the remaining fixed bucket section. Rotatable bucket section 46, left in the illustration, is shown raised by one hydraulic cylinder 50 and secured vertically by safety arm 60. Safety arm 60 has been rotated manually from a rest position on frame 14 and attached to safety arm attachment stub 58. Rotatable bucket section 46A on the right side in the illustration is in the down original position retained horizontal by arm pressure from the extended arm of hydraulic cylinder50 attached to triangular hydraulic cylinder arm attachment 50A on the frame of bucket section 46. Hydraulic feed lines 52 for rotatable bucket sections hydraulic cylinders 50 are crosswise between vertical members of support frame 14. Bucket end sections 24 are shown relative to vertical and horizontal positions of bucket sections 46 and 46A to which they are attached. The top frames of rotatable bucket sections 46 and 46A attach pivotal to frame 14 at rotatable bucket pivotal structures 48. Movement arrows 44 show the upward and downward rotation of bucket sections 46 and 46A.

Modified field finishing land plane 10A according to the invention is shown in FIG. 8 ready for road towing. Tongue 30 is attached to vehicle trailer hitch 78 and hydraulic lines 52 have been snapped loose from clips 86 and are attached to the hydraulic server unit 76 in tow vehicle 74. Modified land plane 10A is road ready as previously illustrated in FIGS. 4, 5, and 6. A safety chain 72 would be available where needed for travel along a road surface 80, as would auxiliary operational lights 68 attached to auxiliary light line 70. Modified land plane 10A as described and illustrated is a field finishing land plane design to be towed by an adequately powered tractor for land leveling and field finishing. For field finishing use, modified land plane 10A would be assembled as described herein and illustrated at FIG. 3. Because of the size and width of this type of equipment, especially the width, towing the unit from place to place along public roads 80 can be difficult. The present invention, field finishing land plane 10A, described herein and illustrated in the drawings overcomes this difficulty.

Although I have described my invention with considerable details in the foregoing specification and illustrated it extensively in the drawings, it is to be understood that I may make changes in the structure of the device so long as any changes made remain within the scope of the appended claims and any changed devices similar to mine made by others that fall within my claim scope, I shall consider such devices to be my invention.

What is claimed is:

1. A modified field finishing land plane, comprising:

a. Two elongated girders orientated horizontally in parallel alignment forming a V-shaped main frame for said land plane, said main frame girders converging to form a front end of said land plane, said main frame girders separating into a widened rear end of said land plane, said converging girders at said front end of said land plane pivotably attached to a pair of yoked, steerable rollers, said yoke of said front end steerable rollers fastened to a vehicular-type tow bar, said widened rear end of said main frame affixed to a rear crosswise member, said rear crosswise member extending a portion outward past said affixment to said main frame on both sides, said extended portions being hinged-on support sections for individual rear rollers affixed by a yoke to swivel at outer terminal ends of said support sections;

b. an elongated scooping bucket centrally affixed crosswise under said V-shaped frame of said land plane, said scooping bucket structured in three sections including a rotatable first bucket section, a fixed second bucket section, a rotatable third bucket section, said second fixed bucket section being center support for pivotal attachment of said first and said third bucket sections that extend outward on each side sufficiently clear of said V-shaped frame of said land plane to be rotated from a substantially horizontal position to a substantially vertical position narrowing the width of said land plane centrally for road towing safety;

c. means for rotating said rotatable first and third bucket sections from a substantially horizontal original position to a substantially vertical position and returning said bucket sections to said original position;

d. safety means for temporary maintenance of said rotatable first and third bucket sections in said substantially vertical position;

e. at least one pair of road wheels useful on and off public roads;

f. means for raising said road wheels allowing said scooping bucket ground contact for field use of said land plane, said means further providing lowering said road wheels for on-road towing of said land plane;

g. means for narrowing said rear cross member at said extended hinged-on support sections for said rear rollers;

h. safety means for temporarily holding said yoked individual rear rollers in a fixed position;

i. means for shielding said main frame converging front end and said pivotal attachment to said pair of yoked, steerable rollers;

j. means for providing support and shock resistance between said shielding means and said vehicle tow tongue.

2. The field finishing land plane of claim 1 wherein said means for rotating said rotatable first and third bucket sections from the substantially horizontal original position to the substantially vertical position and returning said bucket sections to said original position includes hydraulic cylinders affixed with hydraulic fluid supply lines attachable to an auxiliary hydraulic pump and fluid supply source.

3. The field finishing land plane of claim 1 wherein said safety means for temporary maintenance of said rotatable first and third bucket sections in said substantially vertical position includes a manually attached safety arms.

4. The field finishing land plane of claim 1 wherein said road wheels are pneumatic tired road wheels.

5. The field finishing land plane of claim 1 wherein said means for raising said road wheels allowing said scooping bucket ground contact for field use of said land plane, said means further providing a lowering of said road wheels for on-road towing of said land plane including hydraulic cylinders and guide supports connected to said road wheels in a manner to allow said road wheels to be both raised and lowered by activating said hydraulic cylinders.

6. The field finishing land plane of claim 1 wherein said means providing narrowing of said rear cross member at said extended hinged-on support sections for said rear rollers including said extended hinged-on support sections being attached by pin hinges having facing flanges bolted together allowing said support sections to be swung around on the pin hinge moving said rear rollers inward to the back side of said rear cross member.

7. The field finishing land plane of claim 1 wherein said safety means temporary holding said yoked individual rear rollers in a fixed position including a safety cord attached between said yokes of said rear rollers.

8. The field finishing land plane of claim 1 wherein said means shielding said main frame converging front end affixed pivotal to a pair of yoked, steerable rollers including a crescent shaped tubular nose piece shielding member encasing said converging main frame front and pivotal attachment at said steerable rollers yoke.

9. The field finishing land plane of claim 1 wherein said means providing support and shock resistance between said shielding means and said vehicle towing tongue including a pair of shock absorber cylinders affixed one on each side of said shielding means by a first end and attached to said tongue by a second end.

* * * * *